US005322090A

United States Patent [19]

Dornier et al.

[11] Patent Number: 5,322,090

[45] Date of Patent: Jun. 21, 1994

[54] METHOD AND APPARATUS FOR READYING A DEFINED WEFT THREAD RESERVE WHEN THERE IS A LOOM STOPPAGE

[75] Inventors: Peter D. Dornier, Nonnenhorn; Hubertus Ludwig, Lindau-Bodolz, both of Fed. Rep. of Germany

[73] Assignee: Lindauer Dornier Gesellschaft mbH, Lindau, Fed. Rep. of Germany

[21] Appl. No.: 30,898

[22] Filed: Mar. 15, 1993

[30] Foreign Application Priority Data

Mar. 16, 1992 [DE] Fed. Rep. of Germany ..... 4208383

[51] Int. Cl.[5] ..... D03D 47/30; D03D 51/34

[52] U.S. Cl. ..... 139/452; 139/116.2; 139/370.2

[58] Field of Search ..... 139/450, 452, 116.2, 139/370.2

[56] References Cited

U.S. PATENT DOCUMENTS

| | | | |
|---|---|---|---|
| 4,541,462 | 9/1985 | Tholander | 139/452 |
| 4,843,290 | 6/1989 | Sainen et al. | 139/452 |
| 5,050,647 | 9/1991 | Baeck et al. | 139/452 |
| 5,123,455 | 6/1992 | Maina | 139/452 |

FOREIGN PATENT DOCUMENTS

| | | |
|---|---|---|
| 0310804 | 4/1989 | European Pat. Off. . |
| 0318861 | 6/1989 | European Pat. Off. . |
| 0319026 | 6/1989 | European Pat. Off. . |
| 0322576 | 7/1989 | European Pat. Off. . |
| 0284766 | 5/1991 | European Pat. Off. . |
| 2228131 | 12/1972 | Fed. Rep. of Germany . |

*Primary Examiner*—Andrew M. Falik
*Attorney, Agent, or Firm*—W. G. Fasse; W. F. Fasse

[57] ABSTRACT

Tearing of a weft thread between the main nozzle and the insert side of the selvage or insert end of the loom shed is to be avoided when the weft thread has not been properly woven into the fabric. The detection of a faulty weft thread stops the loom and such stopping must not tear the weft thread. For this purpose the signal caused by a faulty weft thread for the loom stoppage is also used for holding available a defined length of weft thread, whereby thread tearing is avoided. The loom is provided with a prespooling device equipped with an electrically controllable thread stopper and a second thread stopper which is adjustable in the circumferential direction and radially on the thread winding body of the prespooling device for providing the defined weft thread length.

6 Claims, 2 Drawing Sheets

METHOD AND APPARATUS FOR READYING A DEFINED WEFT THREAD RESERVE WHEN THERE IS A LOOM STOPPAGE

FIELD OF THE INVENTION

The invention relates to a method and an apparatus for making available a defined weft thread reserve when a weaving stop occurs in an air nozzle weaving loom running at a high r.p.m.

BACKGROUND INFORMATION

Methods and devices are known for removing of broken weft threads from air nozzle weaving looms, see among others DE-OS 2,228,131, EP-Application 0,284,766, EP-Application 0,322,576, EP-Application 0,318,861, and EP-Application 0,319,026.

All these methods and devices are based on monitoring the proper insertion of the weft threads and on automatically removing any weft thread not properly inserted. These weft threads are inserted into the loom shed by the main nozzle of an air nozzle weaving loom under the control of a thread storage. The monitoring of the weft thread insertion takes place by means of so-called thread monitors which provide information to the loom control at least regarding the beginning of the weft thread insertion into the loom shed and regarding the arrival or non-arrival of the weft thread at the exit of the loom shed. If the arrival of the weft thread is not signalled, then the loom control automatically stops the loom. Generaly, the cause for the absence of an arrival signal is a breaking of the weft thread, either on its way into the loom shed, or in the loom shed itself.

In a high speed loom in which the main nozzle and the reed are rigidly connected with the back and forth swinging sley, a predetermined length of the made ready weft thread is released when the loom suddenly stops. The released length of weft thread is held taut in the area between the main nozzle which moves along with the sley and the fabric selvage. This feature makes sure that the made ready weft thread is not torn off by the faulty inserted weft thread when the sley is moved back. This solution is known from European Patent Publication 0,310,804.

European Patent Publication 0,310,804 relates to a method for removing a faultily inserted weft thread in an air weaving loom and to an apparatus for performing the method. The known method aims at solving the technical problem to provide a method that makes it possible to separate a faultily inserted weft thread with relatively large forces from the beat-up edge of the fabric, whereby these relatively large forces are to be applied substantially along the entire length of the loom shed. This problem has been solved, in said European Application, in that the made available weft thread is released sequentially in several length sections, whereby each section is smaller than twice the weft thread length, and wherein these length sections are shot through the loom shed together with the faultily inserted weft thread by means of the main nozzle and the auxiliary nozzles applying several transport impulses to the weft thread. In a modification it is provided that following a signal by the weft thread monitor indicating a faulty weft thread, a predetermined length of the made available weft thread is released and held taut in the area between the main nozzle that moves along with the sley and the selvage of the fabric. Thereby, it is achieved that the made ready weft thread is not torn off of the faultily inserted weft thread when the sley is moved back, because the length of thread is made available for this motion. Thereby, it is also prevented that the thread length enters into the area of the already newly formed shed so that a disturbance could occur in the further work sequence.

In order to make it possible to hold the weft thread taut while simultaneously preventing its tearing, it is known that the weft threads which are provided by a supply spool, and which are spooled off by means of a prespooling device, are made available in a predetermined number of turns which correspond to the length of the weft thread to be inserted. For this purpose, the prespooling device is equipped with a magnetic clamping mechanism which is also referred to as thread stopper by means of which the made available weft thread is clamped to the prespooling device or released.

Downstream of the prespooling device in the direction toward the loom, there is arranged a preblowing nozzle which is so constructed that when the breakage of a weft thread occurs, the preblowing nozzle is capable of exposing a portion of the weft thread winding pulled off the prespooling device, to pressurized air directed opposite to the spooling off direction. Thus, the section of the weft thread between the fabric selvage and the main nozzle can be held taut in a controlled manner, whereby tearing of the weft thread and formation of loops of the weft thread are avoided.

However, the known solution is subject to a disadvantage nevertheless in that namely between the prespooling device and the main blowing nozzle, a preblowing nozzle is arranged, having a complicated construction, and such nozzle is needed as an additional structural component, which requires a specialized pneumatic control.

SUMMARY OF THE INVENTION

Thus, it is the object of the present invention to provide features that are more cost efficient than those known from the prior art, which avoid tearing of the weft thread between the main nozzle and the insertion side selvage of a weft thread faultily woven into the fabric when the loom is stopped.

According to the present method, following the stopping of the weaving operation in response to a weft thread break signal, a shorter defined length $\Delta c$ of weft thread is made ready by an electrical control of the prespooling device, said shorter weft thread length $\Delta c$ deviating from the predetermined and held available weft thread length L. For this purpose, the prespooling devices known as such, are equipped with at least one further electrically controllable thread stopper in addition to the thread stopper for releasing the weft thread length L. While one thread stopper is preferably connected with the housing of the prespooling device in a fixed position, the further thread stopper is arranged adjustably around the circumference direction of the prespooler winding body through a tilting angle $\rho$ relative to the arrangement of said one thread stopper.

The tilting range of the further thread stopper is referred to by the tilting angle $\rho$. The tilting range corresponds to the defined thread length $\Delta c$, which is released following a weft thread break signal by the further thread stopper temporarily on the prespooling device. Thus, tearing of the weft thread along the length $\Delta c$ is avoided. As in the prior art, the tensioning of the weft thread along the thread length $\Delta c$ is achieved by making ready of the defined thread length Δc. The formation of thread loops, which regularly occur when too large a thread release takes place, is also prevented.

The solution according to the invention does not require a preliminary blowing nozzle of complicated construction, nor a respective pneumatic control for making available a defined thread length Δc. Rather, merely a cost efficient further electrically controllable thread stopper is required on the prespooling device.

BRIEF DESCRIPTION OF THE DRAWINGS

The invention will not be described in more detail with reference to the example embodiments shown in the drawings, wherein.

DETAILED DESCRIPTION OF THE PREFERRED EMBODIMENTS

Figure 1:
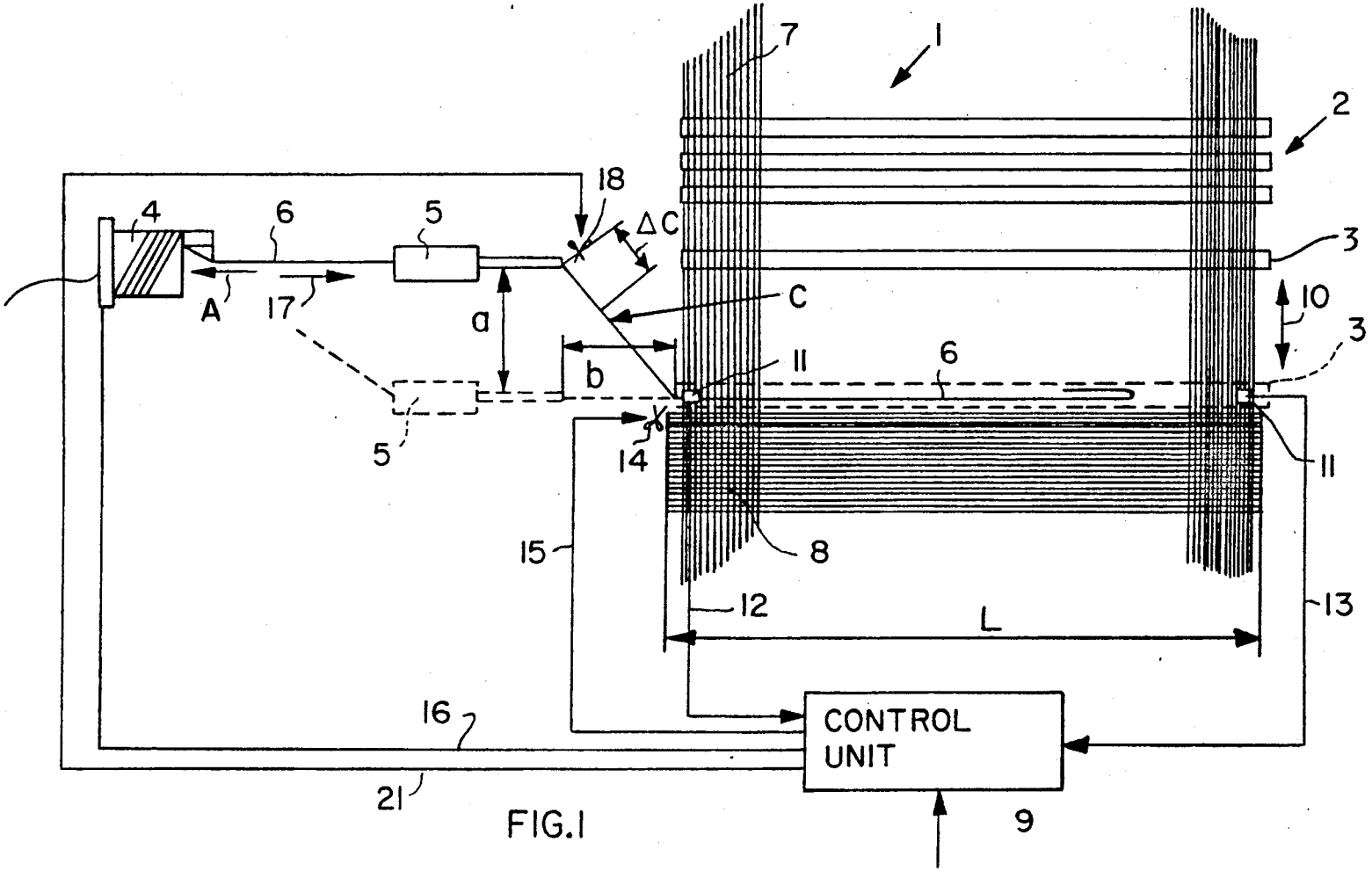
FIG. 1 is a schematic illustration of an air nozzle weaving loom for making ready according to the invention, a defined weft thread reserve from the prespooling device.

The air nozzle weaving loom 1 shown schematically in FIG. 1 comprises substantially the following components: heald shafts 2 forming the loom shed, a reed 3, a prespooling device 4 which feeds to the main nozzle 5, measured lengths of weft thread 6 for forming the fabric 8 of the weft threads and the warp threads 7, and a control unit 9. The main nozzle 5 and the reed 3 are connected with the sley not shown here. The weft thread 6 inserted into the open loom shed, is beat-up to the fabric 8 and bound in by the reed 3. The dashed illustrated position of the reed 3 and of the main nozzle 5 shows both elements in the weft thread beat-up position. The reed 3 and the main nozzle 5 thus perform a continuous tilting motion in accordance with the weaving cycle in the direction of the double arrow 10. One or several sensors 11 distributed along the weaving width of the loom, signal to the control unit 9, which controls the function of the loom, through respective control conductors 12 and 13, the passage of the leading edge of the weft thread 6 past the respective sensor. The sensors 11 signal through the control conductors 12, 13 the arrival or absence of the weft thread to be inserted into the loom shed. In case the weft thread 6 does not appear, the control unit 9 receives a signal from at least one of the sensors 11 to stop the loom.

Scissors 14 arranged on the insertion side of the selvage, does not receive any signal, due to the stopping of the loom, through the control conductor 15 for cutting off a weft thread 6 that has not been properly inserted.

Concurrently with the "loom stop" signal, the prespooling device 4 receives through the control conductor 16, a control instruction for releasing a defined length of thread of at least Δc calculated by the formula $$\Delta c = \sqrt{a^2 + b^2} - b,$$

wherein:

a = to the on-center spacing between the forward and rear main nozzle position, b = to the weft thread length between the outlet of the main nozzle pipe and the left selvage when the main nozzle is in its forward, dashed line position, and c = to the weft thread length between the outlet of the main nozzle pipe and the left hand weaving selvage when the main nozzle is in its rear, full line position.

Figure 2:
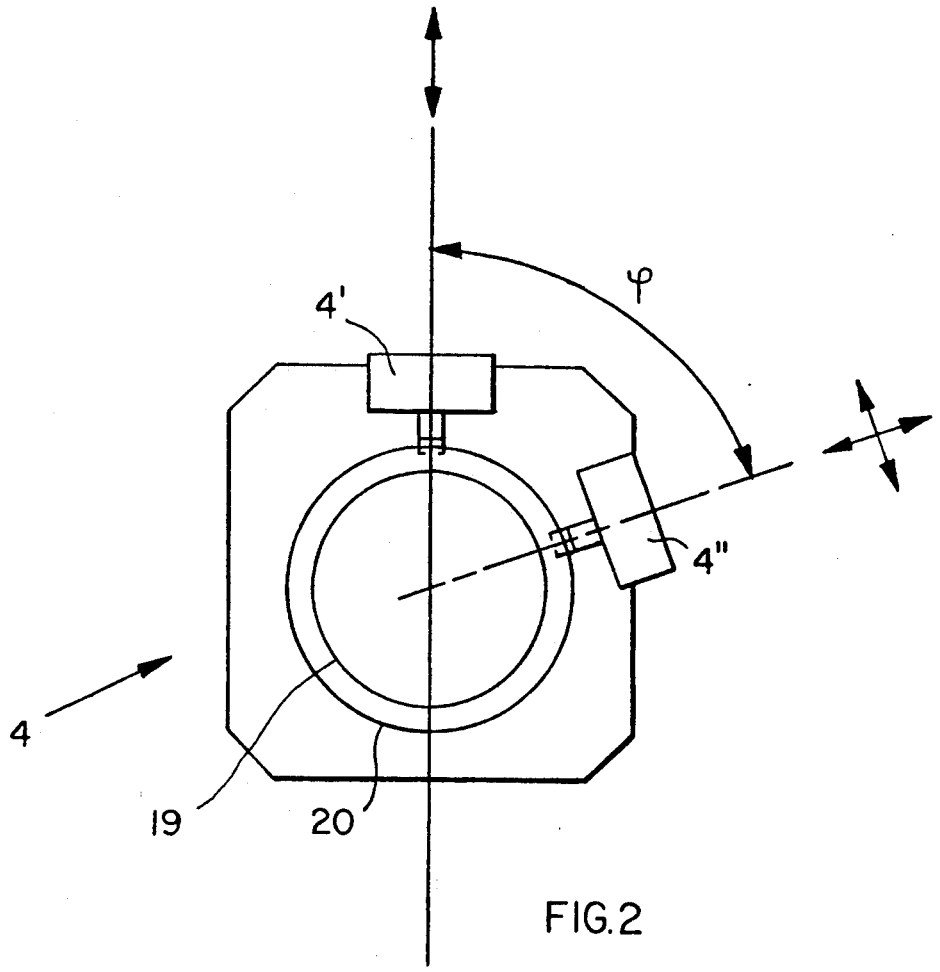
FIG. 2 is a prespooling device as viewed in the direction of the arrow A in FIG. 1 and equipped with two thread stoppers.

According to the invention the prespooling device 4 is specifically equipped with a first thread stopper 4' and a further thread stopper 4'' as shown in FIG. 2 for this control operation.

The defined weft thread reserve is released in the direction of the arrow 17. Thus, when a sudden loom stop occurs, and due to the effective mass inertia moments, the reed 3 and the main nozzle 5 can tilt away, from the beat-up edge without causing the tearing of the weft thread 6 on the length "c".

The not properly inserted weft thread 6 may now be separated from the fabric 8 in a manner known as such. The removal of the weft thread from the loom shed is again sensed by the sensor 11 arranged at the shed exit or at the exit of the reed for signalling to the control unit 9, which on its part controls, for example, a second scissors 18 arranged in the area of the exit of the main nozzle pipe, through the control conductor 21, whereupon the second scissors 18 cuts off the weft thread 6 from the weft thread supply held available. When the incorrectly inserted weft thread 6 has been fully removed from the loom shed, the loom stop is cancelled and the weaving operation proceeds.

FIG. 2 shows the prespooling device 4 that is equipped with two thread stoppers 4', 4'', as mentioned. The first thread stopper 4' releases a predetermined weft thread length of the thread reserve wound onto the cylindrical winding body 19 of the prespooling device 4 between successive weft thread insertions. For this purpose, the thread stopper 4' is controlled by the control unit 9 of the loom.

According to the invention, the second thread stopper 4'' is provided for being effective on the predetermined weft thread reserve. Preferably, the further thread stopper 4'' responds to the above mentioned control unit 9 in accordance with a signal released by a sensor 11 for monitoring the proper weft thread insertion into the loom shed. The second thread stopper 4'' releases only a defined weft thread length Δc which is sufficient to avoid a weft thread tearing when a sudden loom stop occurs in response to the sensor 11 that monitors the proper weft thread insertion. For this purpose, the further thread stopper 4'' is adjustable in the circumferential direction 20 of the winding body 19 and in the radial direction toward the circumference of the winding body 19, please see the crosswise double arrows. The angular measure ρ which defines the circumferential spacing of the further thread stopper 4'' relative to the thread stopper 4', corresponds to the measure Δc according to FIG. 1.

We claim:

1. A method for avoiding tearing a faulty weft thread that must be removed from a fabric in an air weaving loom having weft thread supply means for feeding weft threads into a loom shed of said air weaving loom, comprising the following steps:

(a) generating a loom stop signal in response to detecting said faulty weft thread, (b) stopping a further weaving operation of said loom in response to said loom stop signal, and (c) simultaneously with said generating of said loom stop signal, providing a control signal to said weft thread supply means for releasing a defined length ($\Delta c$) of weft thread (6) which deviates from a weft thread length (L) normally fed to a main blowing nozzle of said air weaving loom when no stopping occurs, said defined length ($\Delta c$) of weft thread (6) being sufficient for said avoiding of said tearing of said faulty weft thread.

2. The method of claim 1, comprising applying said control signal as an electrical control to said weft thread supply means.

3. The method of claim 1, comprising defining said defined length ($\Delta c$) of weft thread by the following relationship:

$$\Delta c = \sqrt{a^2 + b^2} - b,$$

wherein a: is an on-center spacing between a forward and rearward position of said main nozzle of said air weaving loom, b: is a weft thread length between an exit of said main nozzle and a point on an edge of said fabric next to said main nozzle in its forward position, and c: is a weft thread length between said exit of said main nozzle and said point on said edge of said fabric, however with said main nozzle now in its rearward position.

4. An apparatus for avoiding tearing a faulty weft thread that must be removed from a fabric in an air weaving loom, comprising weft thread supply means for feeding weft threads into a loom shed, at least one detector for generating a loom stop signal in response to detecting said faulty weft thread, a control device (9) connected to said at least one detector for receiving said loom stop signal, and an electrical conductor connecting said control device to said weft thread supply means for supplying, in response to said loom stop signal, a control signal to said weft thread supply means for causing said weft thread supply means to release a defined length ($\Delta c$) of weft thread which deviates from a weft thread length (L) normally supplied when no stopping occurs.

5. The apparatus of claim 4, wherein said weft thread supply means comprise a weft thread prespooling device (4) including at least one weft thread stopper (4") connected through said electrical conductor to said control device (9) for controlling said at least one weft thread stopper (4") to release said defined length ($\Delta c$) of weft thread in response to said control signal.

6. The apparatus of claim 5, wherein said weft thread prespooling device comprises two weft thread stoppers (4', 4"), one of which is adjustable radially and circumferentially relative to said weft thread prespooling device.

* * * * *